US007244138B2

(12) United States Patent
Sasame

(10) Patent No.: US 7,244,138 B2
(45) Date of Patent: Jul. 17, 2007

(54) DOCKING CONNECTOR WITH LOCKING RETRACTABLE GUIDE PINS

(75) Inventor: Naotaka Sasame, Saitama (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/196,648

(22) Filed: Aug. 3, 2005

(65) Prior Publication Data

US 2006/0030196 A1 Feb. 9, 2006

(30) Foreign Application Priority Data

Aug. 3, 2004 (JP) ..... 2004-226937

(51) Int. Cl.
*H01R 13/64* (2006.01)

(52) U.S. Cl. ..... 439/378

(58) Field of Classification Search ..... 439/378, 439/567, 607, 660, 65, 74, 108
See application file for complete search history.

(56) References Cited

U.S. PATENT DOCUMENTS 5,478,253 A 12/1995 Biechler et al.
5,647,758 A * 7/1997 Ichikawa et al. ..... 439/362
5,961,337 A 10/1999 Kordes
5,993,257 A * 11/1999 Maruyama ..... 439/607
6,074,235 A * 6/2000 Brandberg et al. ..... 439/378
6,142,814 A * 11/2000 Wu et al. ..... 439/378
6,358,067 B1 3/2002 Takase et al.
7,044,783 B2 * 5/2006 Fan ..... 439/567
2001/0031570 A1 10/2001 Horikoshi et al.

FOREIGN PATENT DOCUMENTS

JP 08-315910 11/1996
JP 11-288760 10/1999
JP 2000-089850 * 3/2000

OTHER PUBLICATIONS

European Search Report dated Oct. 13, 2005 for Application No. EP 05 10 7169.

* cited by examiner

*Primary Examiner*—Tho D. Ta
*Assistant Examiner*—Vanessa Girardi
(74) *Attorney, Agent, or Firm*—Barley Snyder LLC

(57) ABSTRACT

A docking connector comprises a first connector and a second connector. The first connector has an insulating first housing. The first housing includes guide pins that extend from a mating surface of the first housing. The guide pins are moveable toward and away from the first housing. The guide pins are locked in a position away from the first housing by a locking member. The second connector has an insulating second housing. The second housing includes guide pin receiving openings that receive the guide pins. The second connector has a lock release member for unlocking the guide pins during insertion of the guide pins in the guide pin receiving openings.

15 Claims, 18 Drawing Sheets

PRIOR ART

DOCKING CONNECTOR WITH LOCKING RETRACTABLE GUIDE PINS

FIELD OF THE INVENTION

The invention relates to a docking connector comprising a first connector having guide pins that are moveable upon mating with guide pin receiving openings in a second connector.

BACKGROUND OF THE INVENTION

Electronic devices, such as personal computers, are provided with docking connectors that connect the electronic device to an extension unit. High-density, compact docking connectors having numerous contacts have been developed to increase the performance and networking of the electronic devices. Because of the high density of these docking connectors, it is important that mating connectors in the docking connector are accurately positioned so that all of the corresponding contacts contact each other.

A first example of a docking connector that aligns corresponding contacts to each other is illustrated in JP 11-288760 and shown in FIG. 16. The docking connector 101 includes a first connector 110 that mates with a second connector 120. The first connector 110 is mounted on a first circuit board PCB1 that is provided on a side of a personal computer (not shown). The first connector 110 comprises an insulating first housing 111 and a plurality of contacts 112. A pair of guide pins 113 extends from a mating surface of the first connector 110 and are provided on ends of the first housing 111. The guide pins 113 are constructed so that the guide pin on one end has a larger diameter than the guide pin on the other end. The guide pins 113 are attached to the first housing 111 by attachment fittings 114 that are attached to the first housing 111.

The second connector 120 is mounted on a second circuit board PCB2 provided on a side of an extension unit (not shown). The second connector 120 comprises an insulating second housing 121 and a plurality of contacts 122. A pair of guide members 123 that receive the guide pin 113 of the first connector 110 are provided on each end of the second housing 121. The guide members 123 are attached to the second housing 121 by attachment fittings 124 that are attached to the second housing 121. At the time of mating the first connector 110 and the second connector 120, the guide pins 113 are inserted into the guide members 123. The positional deviation between the first connector 110 and the second connector 120 is absorbed, and it is possible to correctly align all of the contacts 112, 122 with each other.

In the docking connector 101 shown in FIG. 16, the docking connector 101 is for use in right-angle connections so mating surfaces of the first circuit board PCB1 and the first connector 110 and mating surfaces of the second circuit board PCB2 and the second connector 120 are perpendicular. Accordingly, the docking connector 110 is not suitable for applications requiring the mating surfaces of the first circuit board PCB1 and the first connector 110 and the mating surfaces of the second circuit board PCB2 and the second connector 120 to be parallel.

An example of an electrical connector that aligns corresponding contacts to each other is illustrated in JP 8-315910 and shown in FIG. 17. The electrical connector 201 consists of a first connector 210 that mates with a second connector 220. The first connector 210 is mounted on a side of a first circuit board PCB1. The first connector 210 comprises an insulating first housing 211 and a plurality of contacts 212.

A pair of guide pins 213 extends from a mating surface of the first connector 210 at ends of the first housing 211.

The second connector 220 is mounted on a side of a second circuit board PCB2 that is substantially parallel to the first circuit board PCB1. The second connector 220 comprises an insulating second housing 221 and a plurality of contacts 222. A pair of accommodating recessed members 223 into which the guide pins 213 of the first connector 210 are inserted are formed in ends of the second housing 221. When the first connector 210 and the second connector 220 are mated, the guide pins 213 are inserted into the accommodating recessed members 223 so that positional deviation between the first connector 210 and the second connector 220 is absorbed, and it is possible to align all of the contacts 212, 222 with each other.

In the electrical connector 201 shown in FIG. 17, mating surfaces of the first circuit board PCB1 and the first connector 210 and the mating surfaces of second circuit board PCB2 and the second connector 220 are parallel. However, the guide pins 213 of the first connector 210 are accommodated inside the accommodating recessed members 223 in the second connector 220 when the first connector 210 is mated with the second connector 220. Accordingly, the electrical connector 201 can not be formed with a low height. If the length of the guide pins 213 is shortened in order to lower the height, adequate guiding function can not be achieved. Additionally, forming openings in the second circuit board PCB2 for receiving the guide pins 213 will not effectively reduce the height, because wiring or the like is not possible in the openings, so the electrical connector 201 will not be suitable for high-density mounting.

Another example of a docking connector for connecting a personal computer and an extension unit is illustrated in JP 2000-089850 and shown in FIGS. 18–19. The docking connector comprises a first connector 302 and a second connector 311. The first connector 302 is provided on a circuit board 303 on a side of a personal computer 301. The second connector 311 is provided on a side of an extension unit 310 and mates with the first connector 302. Guide pins 312 that guide the first connector 302 and the second connector 311 to the docking position are provided on the extension unit 310. The guide pins 312 extend from an upper housing 310*a* of the extension unit 310 and allow vertical movement of the guide pins 312. The guide pins 312 are biased upward by springs 314.

A groove 312*a* is formed in an outer circumference of each of the guide pin 312. A substantially U-shaped release spring 316 is received in the groove 312*a*. An attachment fitting 318 that restricts the downward movement of the U-shaped release spring 316 is attached to the upper housing 310*a* by a screw 319. A release pin 315 that releases the U-shaped release spring 316 from the groove 312*a* is attached thereto so that the release pin 315 can move in an up and down direction. Each of the release pins 315 is constantly biased upward by a spring 317. A bottom portion of the extension unit 310 is provided with a lower housing 310*b*. Grounding fittings 313 that contact the guide pins 312 when the guide pins 312 are lowered are provided on the lower housing 310*b*.

When the first connector 302 and the second connector 311 are mated, the guide pins 312 of the extension unit 310 enter the guide pin receiving openings 304 in the personal computer 301. Upper ends of the release pins 315 contact a bottom surface of the personal computer 301. Since the U-shaped release springs 316 are received in the grooves 312*a* in the guide pins 312, the downward movement of the guide pins 312 is restricted by the U-shaped release springs 316. When the personal computer 301 is moved further downward, the U-shaped release springs 316 are spread apart by the release pins 315 in a direction of the plate surface of the attachment fittings 318 so that the U-shaped release springs 316 are released from the grooves 312*a*. As a result, downward movement of the guide pins 312 is made possible. When the personal computer 301 is moved further downward, the guide pins 312 contact the grounding fittings 313, and the first connector 302 and the second connector 311 are fully mated.

In the docking connector shown in FIGS. 18–19, the guide pins 312, the U-shaped release springs 316, the attachment fittings 318, the release pins 315, and the springs 317 that lock and unlock the vertical movement of the guide pins 312 are provided in the extension unit 310 separate from the second connector 311. Space inside the extension unit 310 is therefore required, which reduces space in the extension unit 310 for other components and limits design options. Moreover, the mechanism that allows the vertical movement of the guide pins 312 and the mechanism that locks and unlocks the vertical movement of the guide pins 312 is complex, which increases manufacturing costs.

SUMMARY OF THE INVENTION

It is therefore an object of the invention to provide a docking connector with a simple structure in which guide pins provided on a first connector are capable of moving toward and away from the first connector during mating with a second connector so that the need for forming openings for receiving the guide pins in a circuit board on which the second connector is mounted is eliminated.

This and other objects are achieved by a docking connector comprising a first connector and a second connector. The first connector has an insulating first housing. The first housing includes guide pins that extend from a mating surface of the first housing. The guide pins are moveable toward and away from the first housing. The guide pins are locked in a position away from the first housing by a locking member. The second connector has an insulating second housing. The second housing includes guide pin receiving openings that receive the guide pins. The second connector has a lock release member for unlocking the guide pins during insertion of the guide pins in the guide pin receiving openings.

This and other objects are further achieved by a first connector for mating with a second connector of a docking connector wherein the first connector comprises an insulating first housing. The first housing includes guide pins that extend from a mating surface of the first housing. The guide pins are moveable toward and away from the first housing. The guide pins are locked in a position away from the first housing by a locking member.

This and other objects are still further achieved by a second connector for mating with a first connector of a docking connector. The second connector comprises an insulating second housing. The second housing includes guide pin receiving openings. The second connector has a lock release member positioned inside the guide pin receiving openings. The lock release member is formed on an end of a metal shell that includes a grounding tongue.

DETAILED DESCRIPTION OF THE INVENTION

Figure 14:
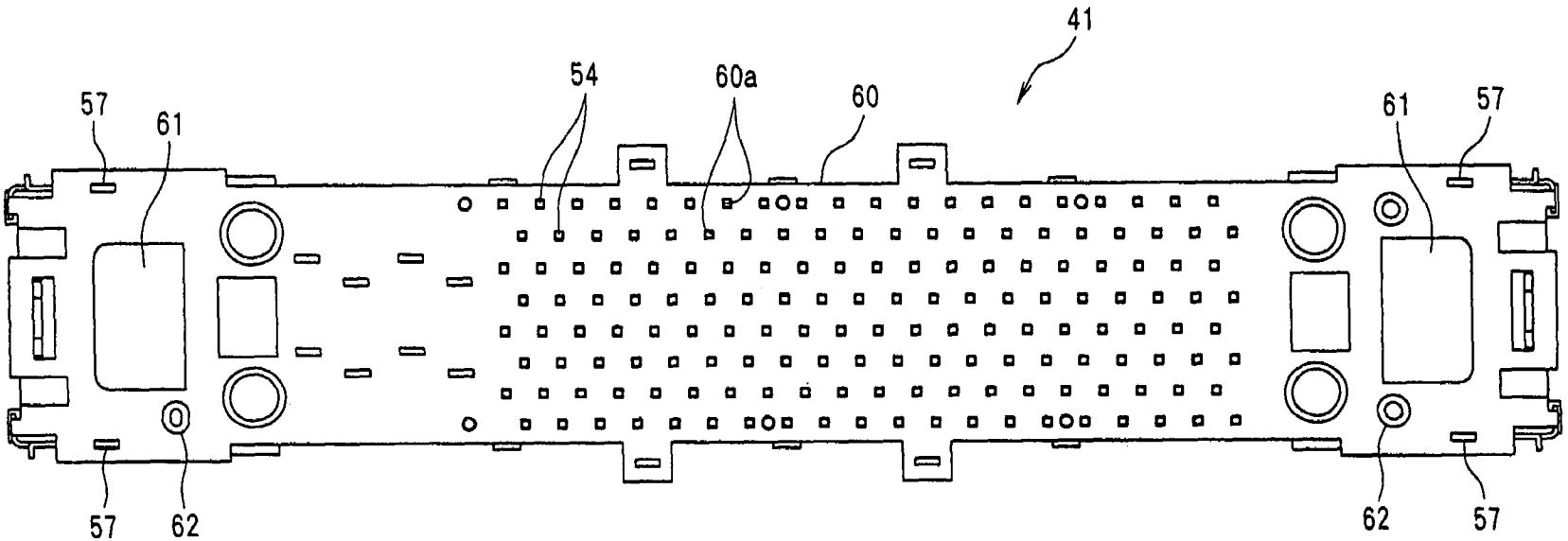
FIG. 14 is a bottom view of the second connector.
Figure 15A:
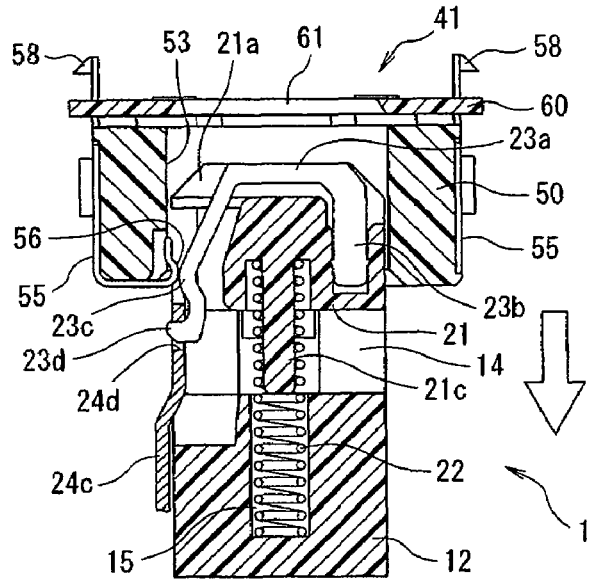
FIG. 15A is an explanatory showing a method of mating the first connector with the second connector at an initial stage in the mating process.
Figure 15B:
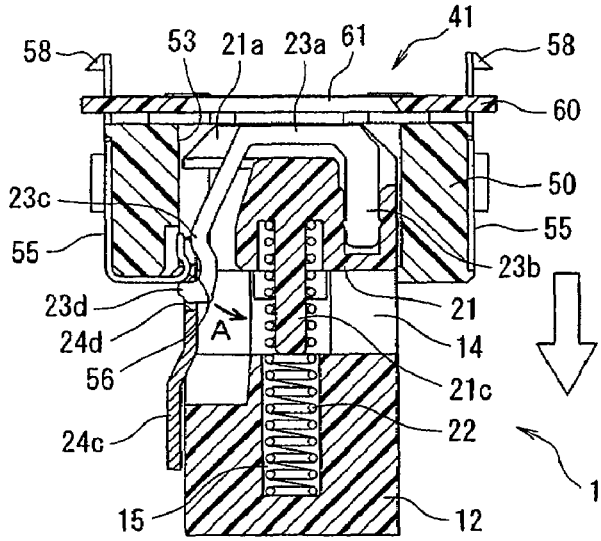
FIG. 15B is showing a method of mating the first connector with the second connector at an intermediate stage of the mating process.
Figure 15C:
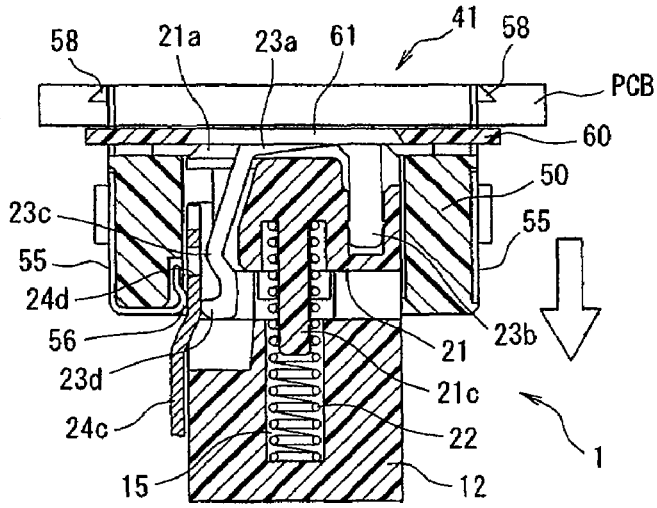
FIG. 15C is showing a method of mating the first connection with the second connection at a final stage in the mating process.
Figure 16:
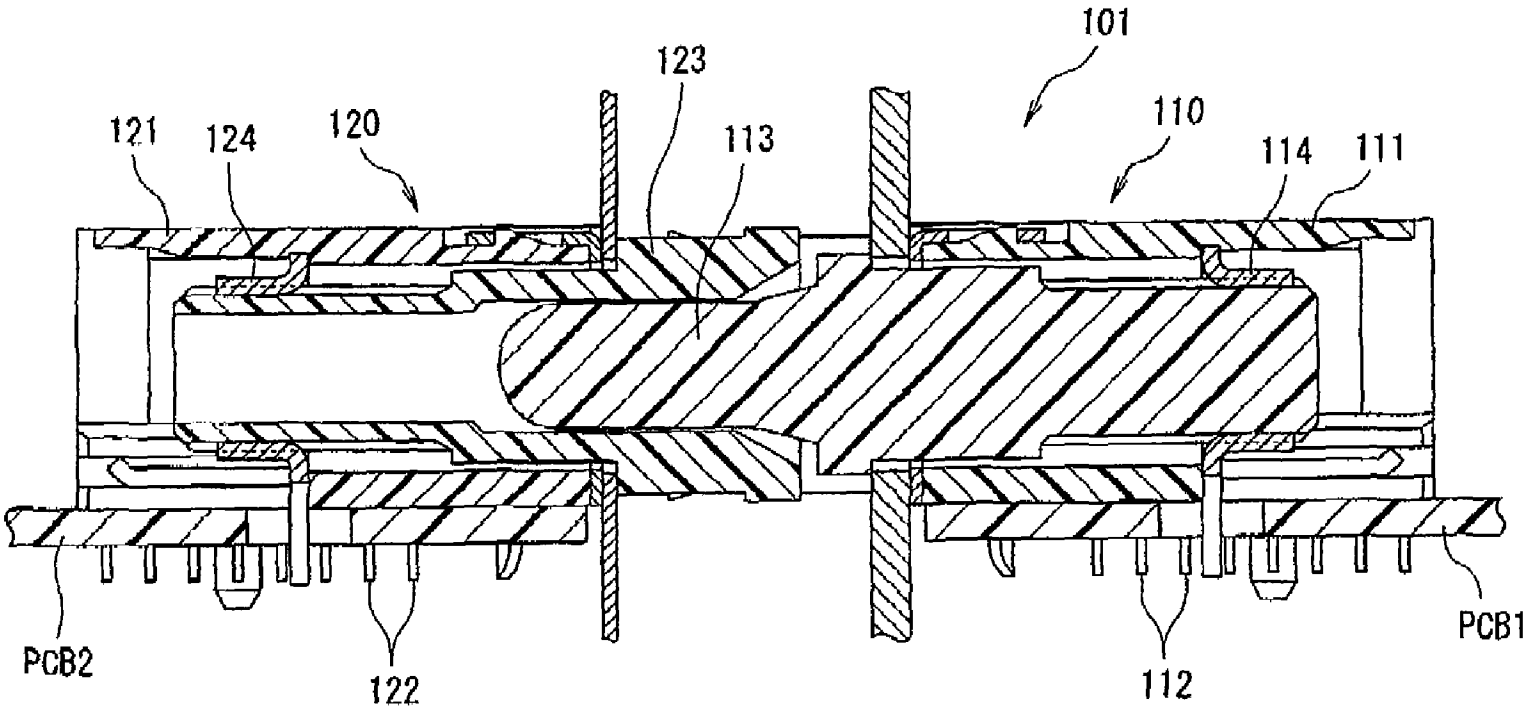
FIG. 16 is a sectional view of a first docking connector of the prior art.
Figure 17:
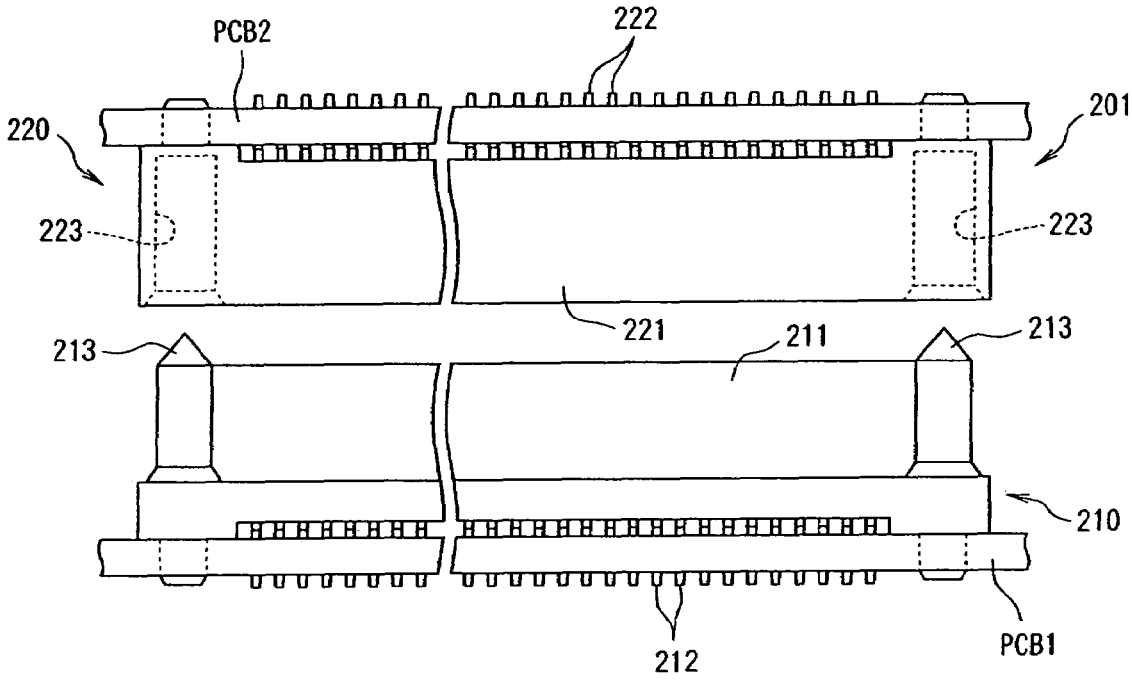
Prior Art F I G. 17
FIG. 17 is an explanatory diagram showing a method of mating a first connector with a second connector of an electrical connector of the prior art.
Figure 18:
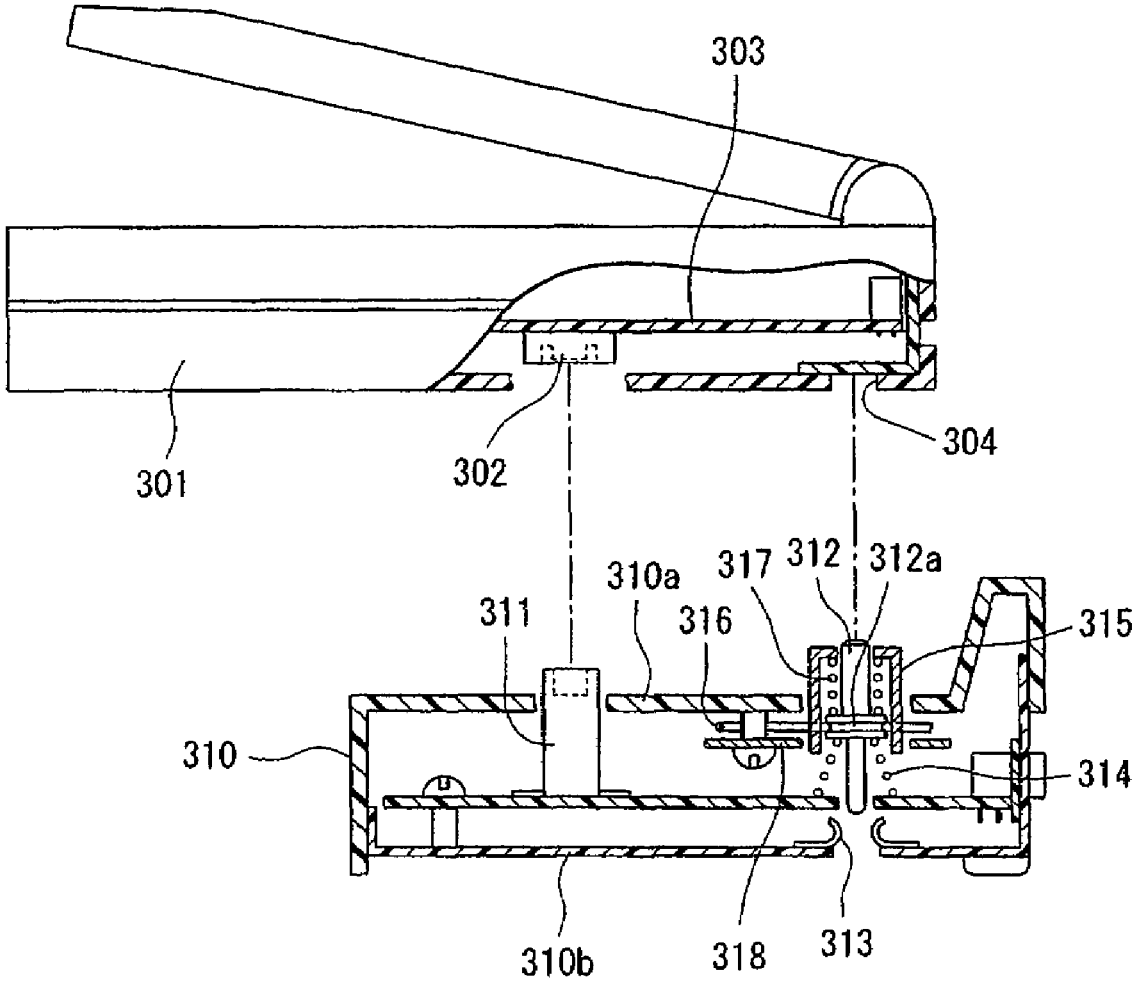
PRIOR ART F I G. 18
FIG. 18 is an explanatory diagram showing a method of mating a first connector with a second connector of another docking connector of the prior.
Figure 19:
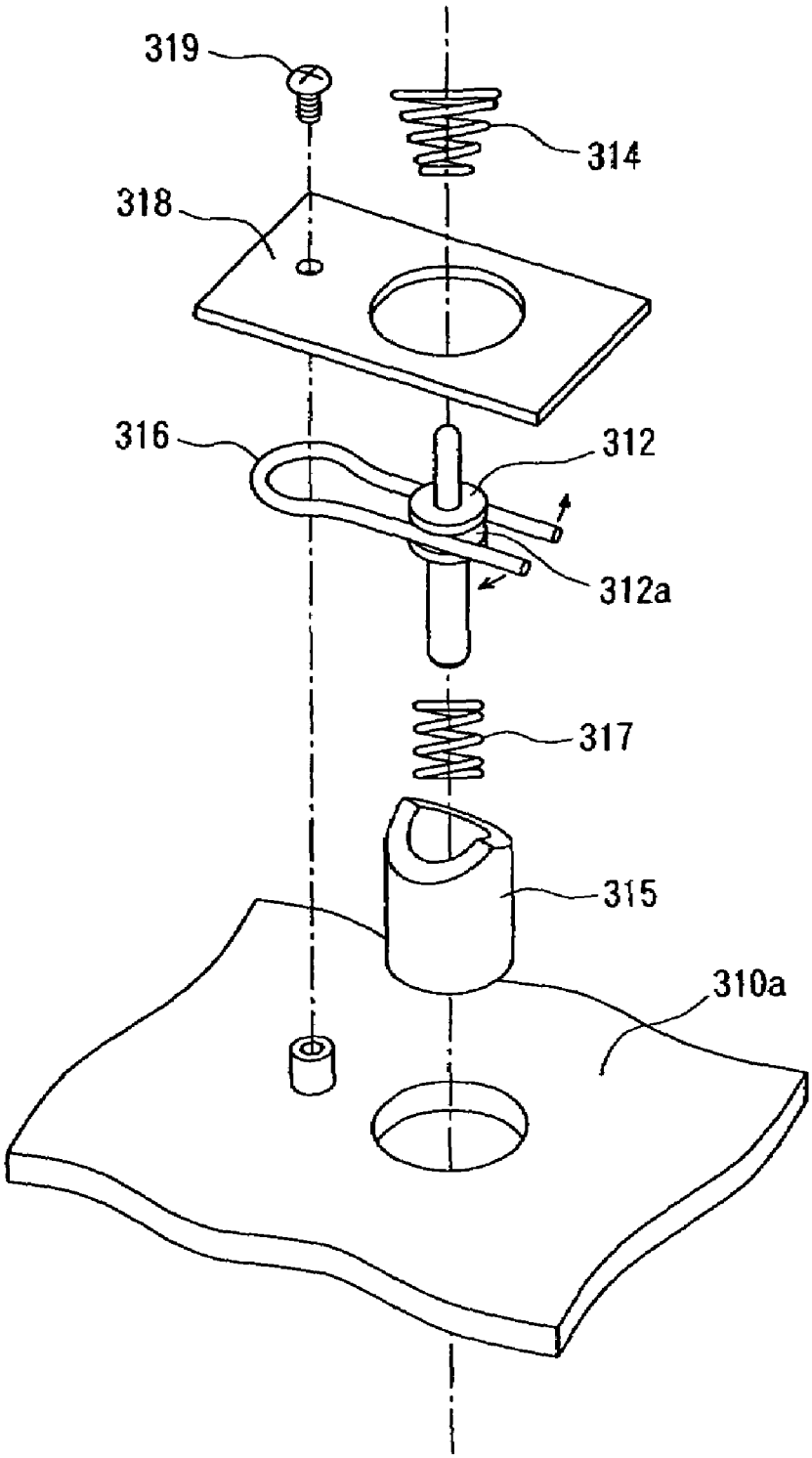
Prior Art F I G. 19
FIG. 19 is an exploded perspective view of the docking connector shown in FIG. 18.

FIGS. 15A–15C show a docking connector of the invention. The docking connector comprises a first connector 1 that mates with a second connector 41. FIGS. 1–10 show the first connector 1. FIGS. 11–14 show the second connector 41.

Figure 1:
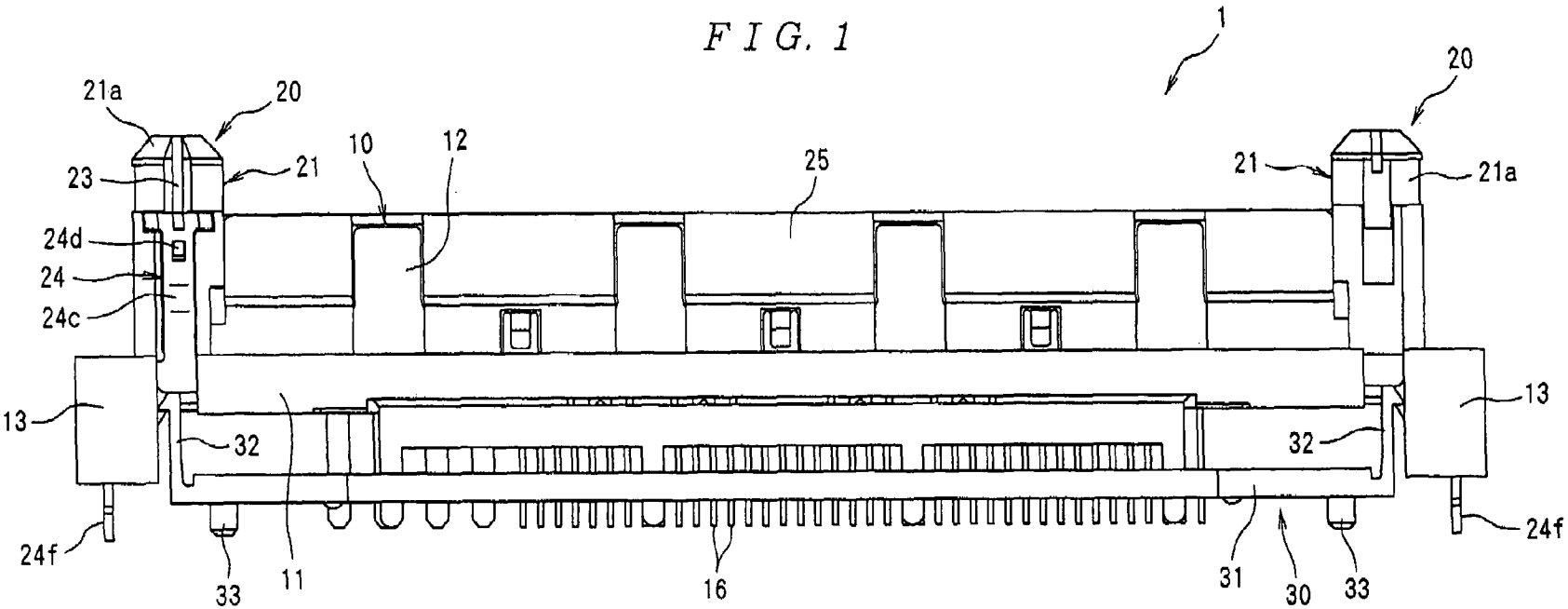
FIG. 1 is a front view of a first connector of a docking connector of the present invention.
Figure 2:
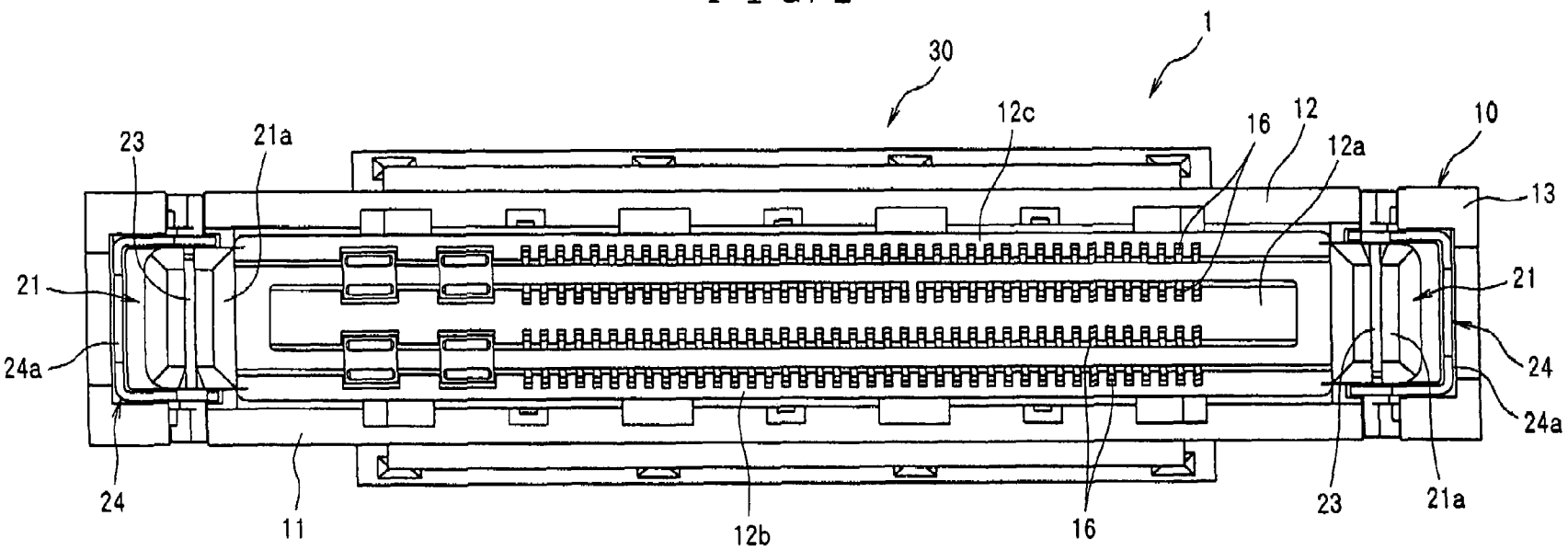
FIG. 2 is a plan view of the first connector.

As shown in FIG. 1, the first connector 1 comprises an insulating first housing 10 that may be formed, for example, by molding an insulating resin. The insulating housing 10 has a substantially rectangular base 11 that extends in a direction of length (left-right direction in FIG. 1). Board mounting members 13 are provided on both sides of the base 11 in the direction of length for mounting the base 11 on a first circuit board PCB1 (FIG. 3) provided on a side of an extension unit (not shown). A mating member 12 extends upward from the base 11. As shown in FIG. 2, the mating member 12 comprises a center wall 12*a* positioned between a front wall 12*b* and a rear wall 12*c*. The center wall 12*a*, the front wall 12*b*, and the rear wall 12*c* extend in the direction of length. As shown in FIGS. 5B and 6B, guide pin accommodating recesses 14 are formed in both sides of the mating member 12 in the direction of length. Spring accommodating recesses 15 are formed in a bottom portion of the guide pin accommodating recesses 14. As shown in FIG. 1, a shell 25 is attached to the periphery of the mating member 12. The shell 25 may be formed, for example, from a metal material.

Figure 8A:
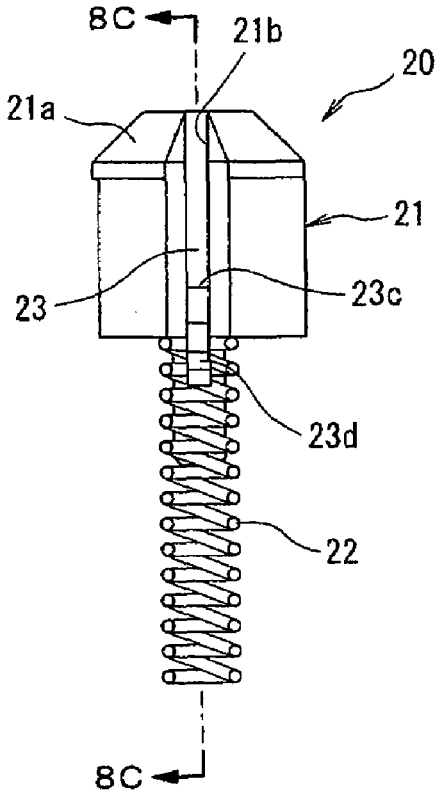
FIG. 8A is a front view of a locking member attached to the guide pin.
Figure 8C:
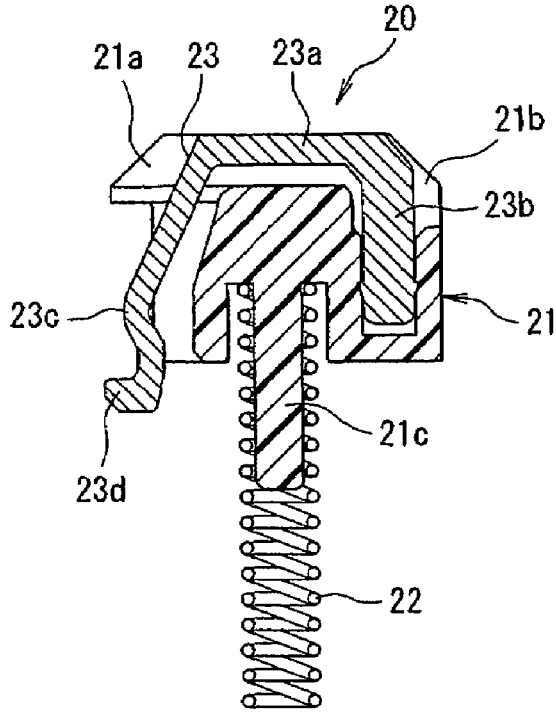
FIG. 8C is a sectional view along line 8C—8C of FIG. 8A.

As shown in FIG. 1, a pair of guide pins 20 corresponding to the guide pin accommodating recesses 14 is provided on the first housing 10. As shown in FIGS. 5A–5B and 8A–8C, each of the guide pins 20 is provided so as to be moveable toward and away from the first housing 10 with respect to the corresponding guide pin accommodating recess 14. Each of the guide pins 20 is constructed from a guide member 21 that protrudes upward from a mating surface of the mating member 12 (upper end surface of the mating member 12). As shown in FIGS. 8A–8C and 9A–9C, each of the guide members 21 comprises a tapered end 21*a*. As shown in FIG. 8C, a spring supporting member 21*c* extends downward from the tapered end 21*a*. A locking member accommodating grooves 21*b* extend in a forward-rearward direction in the tapered ends 21*a*. The locking member accommodating groove 21*b* opens toward a front of the tapered end on the guide pin 20 on the left side of the first housing 10 in the direction of length. The locking member accommodating groove 21*b* opens toward a rear of the tapered end 21*a* on the guide pin 20 on the right side of the first housing 10 in the direction of length. The guide member 21 may be formed, for example, by molding an insulating resin.

Figure 8B:
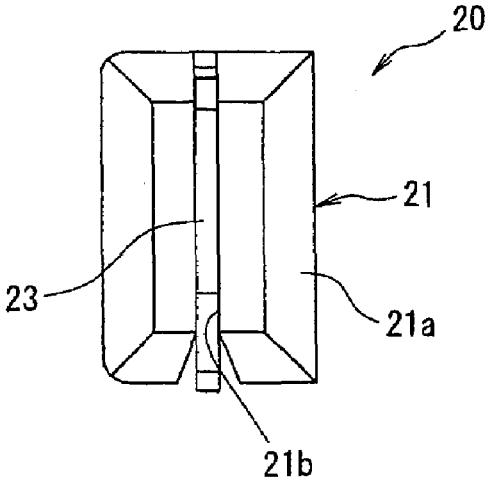
FIG. 8B is a plan view of the locking member attached to the guide pin.
Figure 9A:
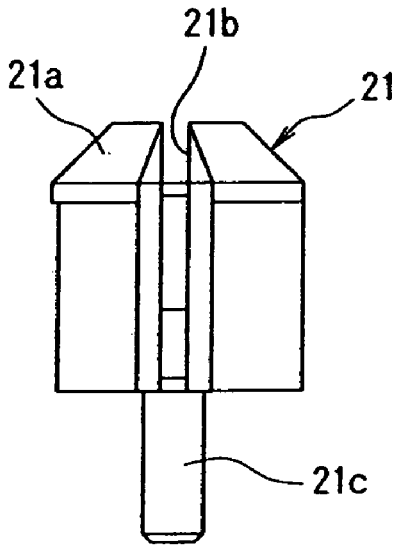
FIG. 9A is a front view of a guide member.
Figure 9C:
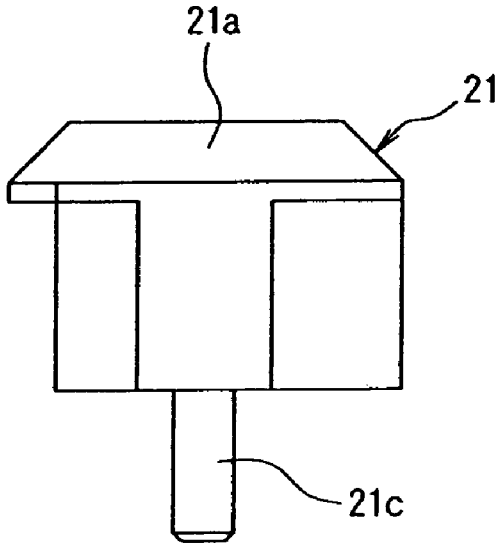
FIG. 9C is a right-side view of the guide member.
Figure 9B:
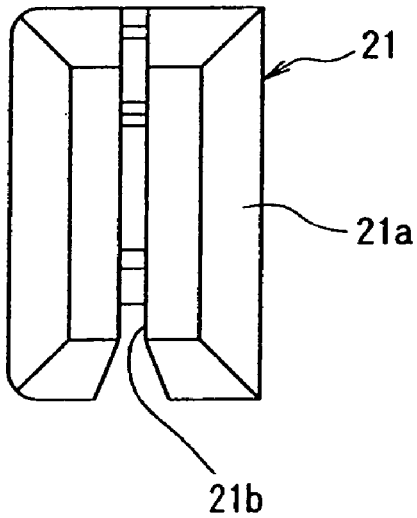
FIG. 9B is a plan view of the guide member.

As shown in FIG. 8B, upper portions of springs 22 are fitted over and supported by the spring supporting members 21*c* of the guide members 21. As shown in FIG. 5B, lower portions of the springs 22 are accommodated inside the spring accommodating recesses 15 of the mating member 12. The springs 22 constantly bias the corresponding guide member 21 upward. The springs 22 may be, for example, compression springs.

Figure 5A:
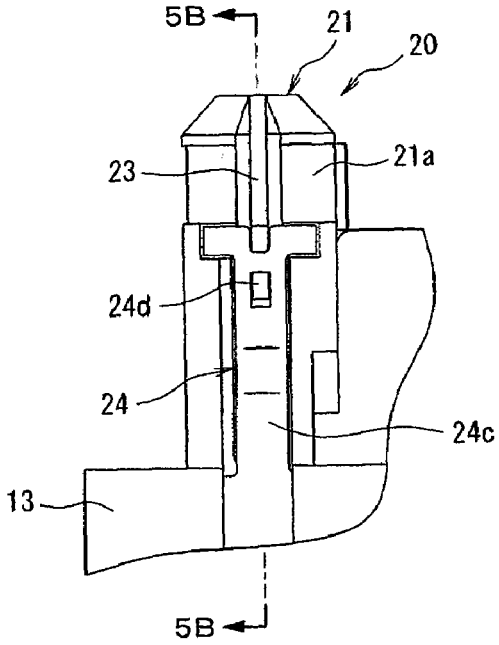
FIG. 5A is front view of a guide pin.
Figure 5B:
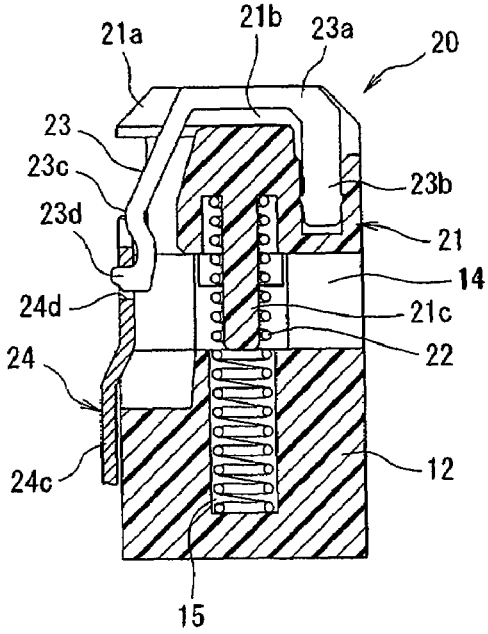
FIG. 5B is a sectional view along line 5B—5B of FIG. 5A.
Figure 6A:
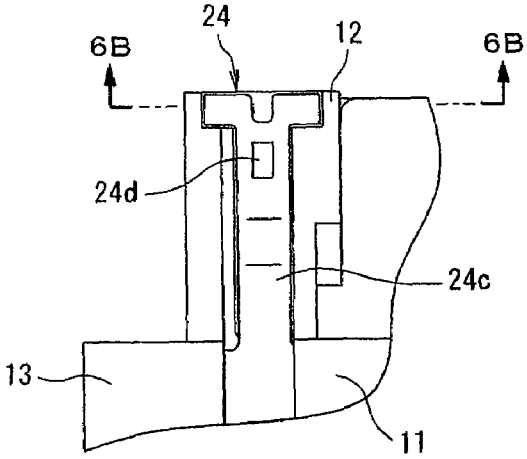
FIG. 6A is a front view of a fastening fitting.
Figure 6B:
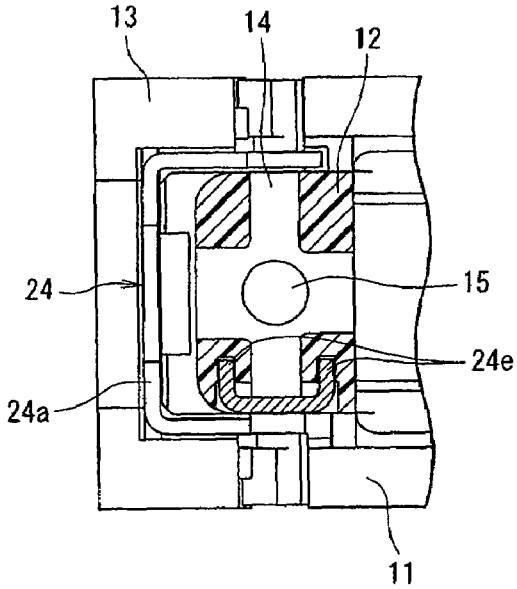
FIG. 6B is a sectional view along line 6B—6B of FIG. 6A.
Figure 10A:
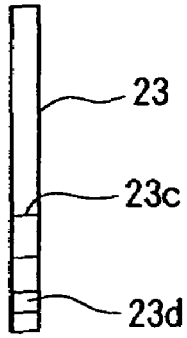
FIG. 10A is a front view of the locking member.
Figure 10C:
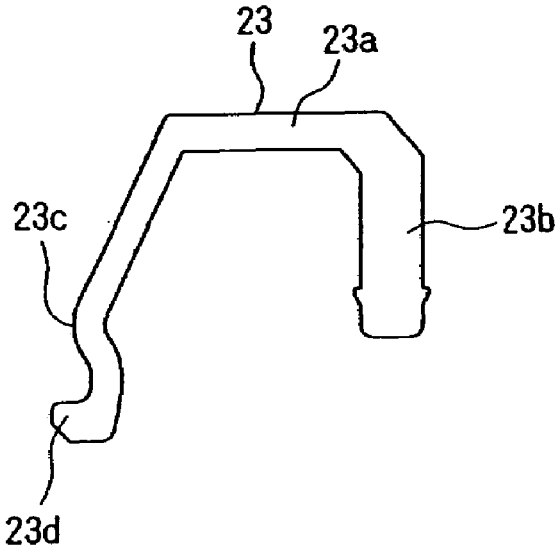
FIG. 10C is a right-side view of the locking member.
Figure 10B:
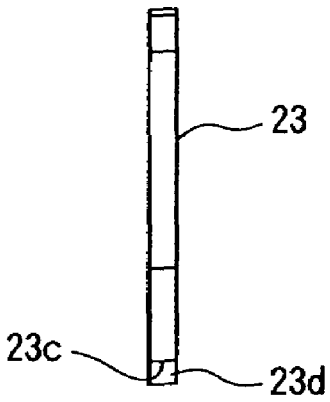
FIG. 10B is a plan view of the locking member.

As shown in FIGS. 5A–5B and 8A–8C, locking members 23, which may be formed, for example, by stamping a metal plate are accommodated in the locking member accommodating grooves 21*b*, as shown in FIGS. 5A–5B. As shown in FIGS. 10A–10C, in the guide pin 20 on the left side of the first housing 10, the locking member 23 comprises a base plate 23*a* that extends in a forward-rearward direction. A press-fitting member 23*b* extends downward from a rear end of the base plate 23*a* and is press-fitted to the tapered end 21*a*. A contact member 23*c* is formed at a front end of the base plate 23*a* at an end of a flexible member that extends downward at an inclination toward the front. A locking projection 23*d* is formed below the contact protruding member 23*c* and extends forward. In the guide pin 20 on the right side of the first housing 10, the locking member 23 comprises the base plate 23*a* that extends in the forward-rearward direction. The press-fitting member 23*b* extends downward from the front end of the base plate 23*a* and is press-fitted to the tapered end 21*a*. The contact member 23*c* is formed at the rear end of the base plate 23*a* at an end of the flexible member that extends downward at an inclination toward the rear. The locking projection 23*d* is formed below the contact protruding member 23*c* and extends rearward.

Figure 7A:
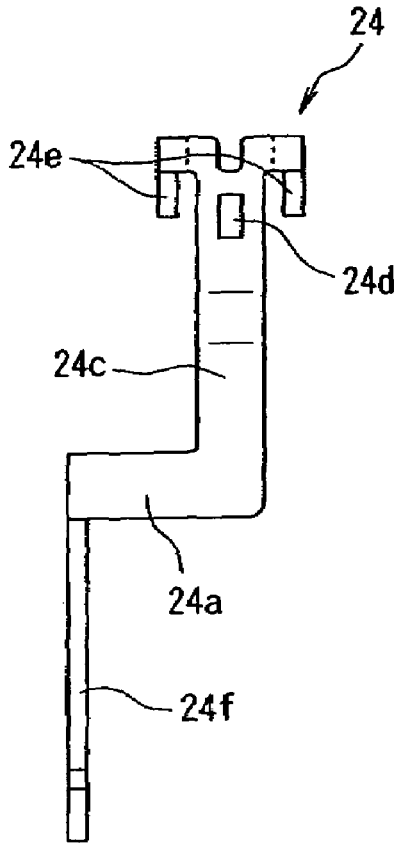
FIG. 7A is a front view of the fastening fitting.
Figure 7C:
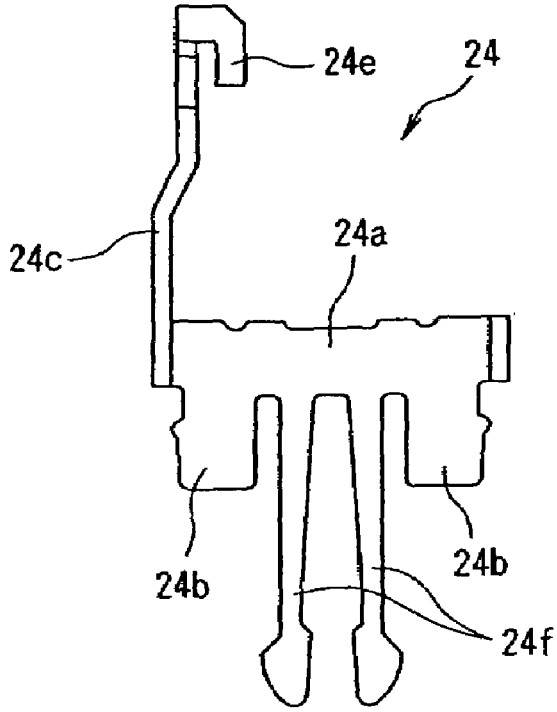
FIG. 7C is a right-side view of the fastening fitting.
Figure 7B:
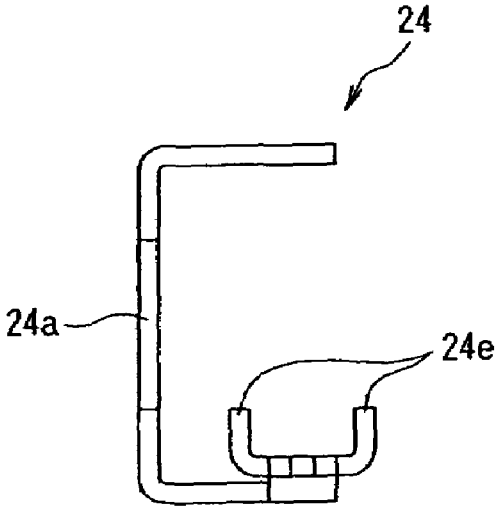
FIG. 7B is a plan view of the fastening fitting.

As shown in FIGS. 1–3, 5A–5B, and 6A–6B, fastening fittings 24 fasten the first connector 1 to the first circuit board PCB1. The fastening fittings 24 are attached to the right and left ends of the mating member 12 in the direction of length. The fastening fittings 24 may be formed, for example, by stamping and forming a metal plate. As shown in FIGS. 7A–7C, the fastening fittings 24 comprise a substantially C-shaped base plate 24*a* that extends in a forward-rearward direction. A pair of press-fitting members 24*b* extends downward from ends (front and rear ends) of the base plate 24*a*. A pair of board fastening members 24*f* extends downward from a portion of the base plate 24*a* between the press-fitting members 24*b*. The press-fitting members 24*b* are press-fit into the corresponding board mounting member 13 of the first housing 10. The board fastening members 24*f* are fastened to the first circuit board PCB1 by passing through the board mounting members 13.

In the fastening fitting 24 on the right end of the mating member 12, a locking piece 24*c* extends upward from an upper portion of the right end of the C-shaped base plate 24*a* at the front end of the base plate 24*a*. In the fastening fitting 24 on the left end of the mating member 12, the locking piece 24*c* extends upward from an upper portion of the left end of the C-shaped base plate 24*a* at the rear end of the base plate 24*a*. As shown in FIG. 7A, a locking aperture 24*d* into which the locking projection 23*d* of the locking member 23 is locked is formed in an upper portion of the locking piece 24*c*. A supporting member 24*e* for supporting an upper end of the locking piece 24*c* on the mating member 12 is provided on the upper end of the locking piece 24*c*. The supporting member 24*e* prevents the locking projection 23*d* from being easily disengaged from the locking aperture 24*d*, since precise positioning of the locking member 23 inside the first housing 10 is required to cause the locking member 23 to perform a locking action.

Figure 3:
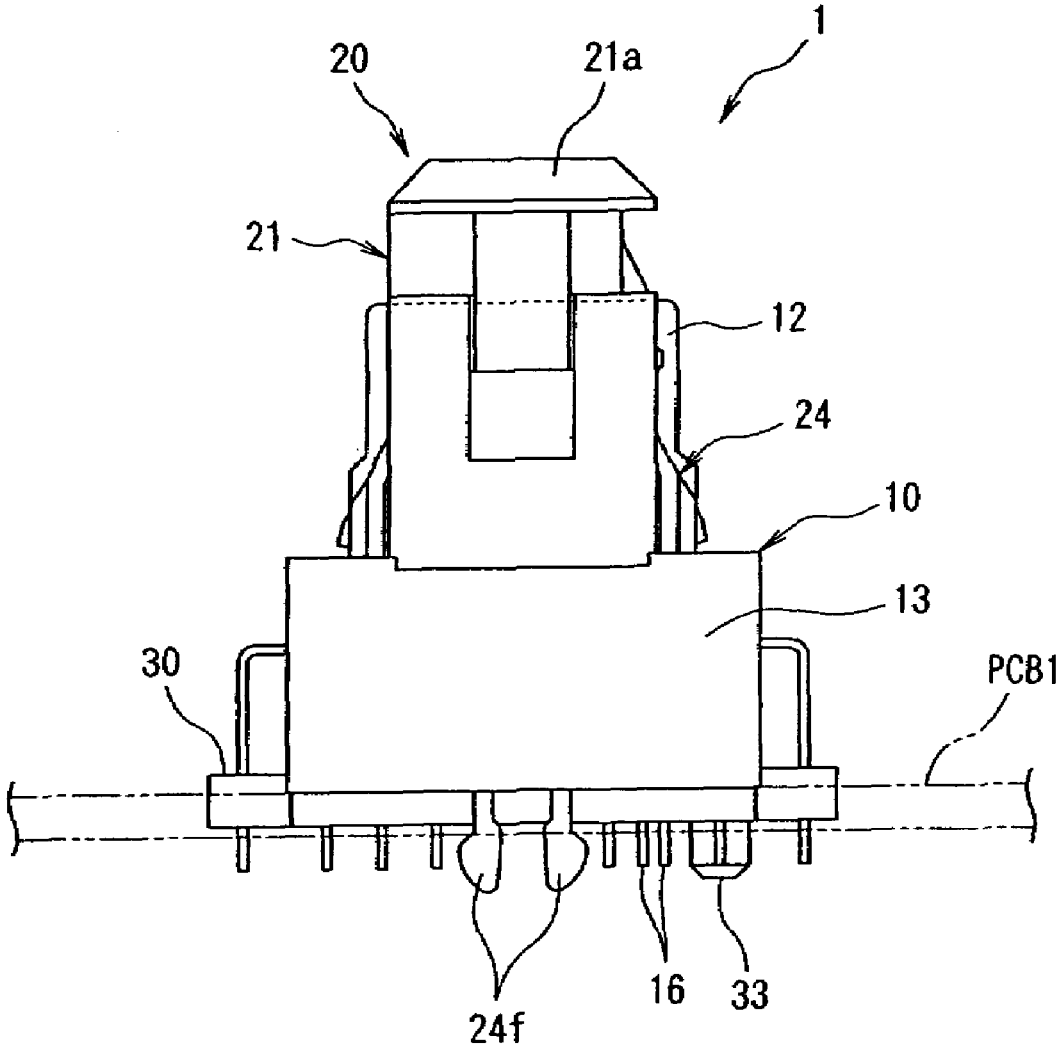
FIG. 3 is a right-side view of the first connector.

As shown in FIGS. 2–3, a plurality of contacts 16 is attached to the first housing 1. The contacts 16 are provided in rows on the center wall 12*a*, the front wall 12*b*, and the rear wall 12*c*. The contacts 16 are connected, for example, by soldering to the first circuit board PCB1.

Figure 4:
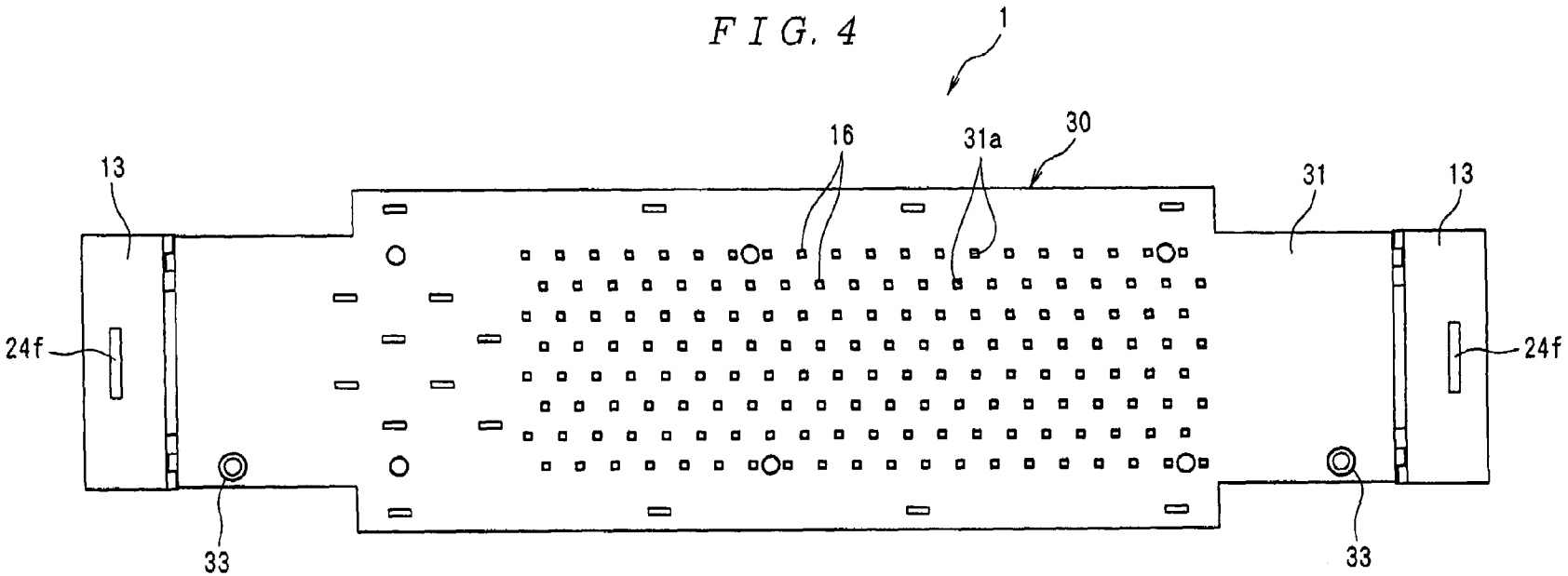
FIG. 4 is a bottom view of the first connector.

A tine plate 30 aligns contact legs of the contacts 16. As shown in FIG. 4, the tine plate 30 comprises a base plate 31 that extends in the direction of length. A pair of locking arms 32 extends upward from either end of the base plate 31 in the direction of length. A plurality of positioning posts 33 extend downward from a vicinity of both ends of the base plate 31 in the direction of length. In order to align the contact legs of the contacts 16, a plurality of through-holes 31*a* through which the contact legs can pass are formed in the base plate 31. The tine plate 30 is designed to move between an initial position shown in FIGS. 1 and 3 and a final position (not shown) located above the initial position. In FIG. 3, since the tine plate 30 is shown in the initial position, the first circuit board PCB1 and the tine plate 30 are graphically represented as overlapping with each other.

Figure 11:
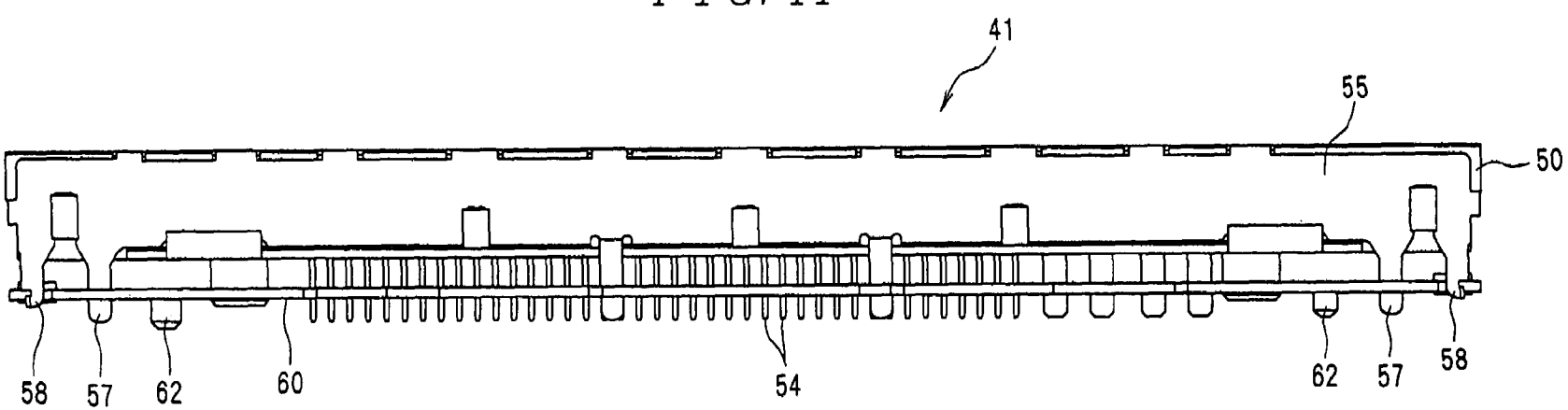
FIG. 11 is a front view of a second connector of the docking connector of the present invention.

As shown in FIG. 11, the second connector 41 comprises an insulating second housing 50 that may be formed, for example, by molding an insulating resin. The second housing 50 extends in a direction of length (left-right direction in FIG. 11), and the second connector 41 is designed to be mounted on a second circuit board PCB2, which is provided on the side of a personal computer (not shown), as shown in FIG. 3B.

Figure 12:
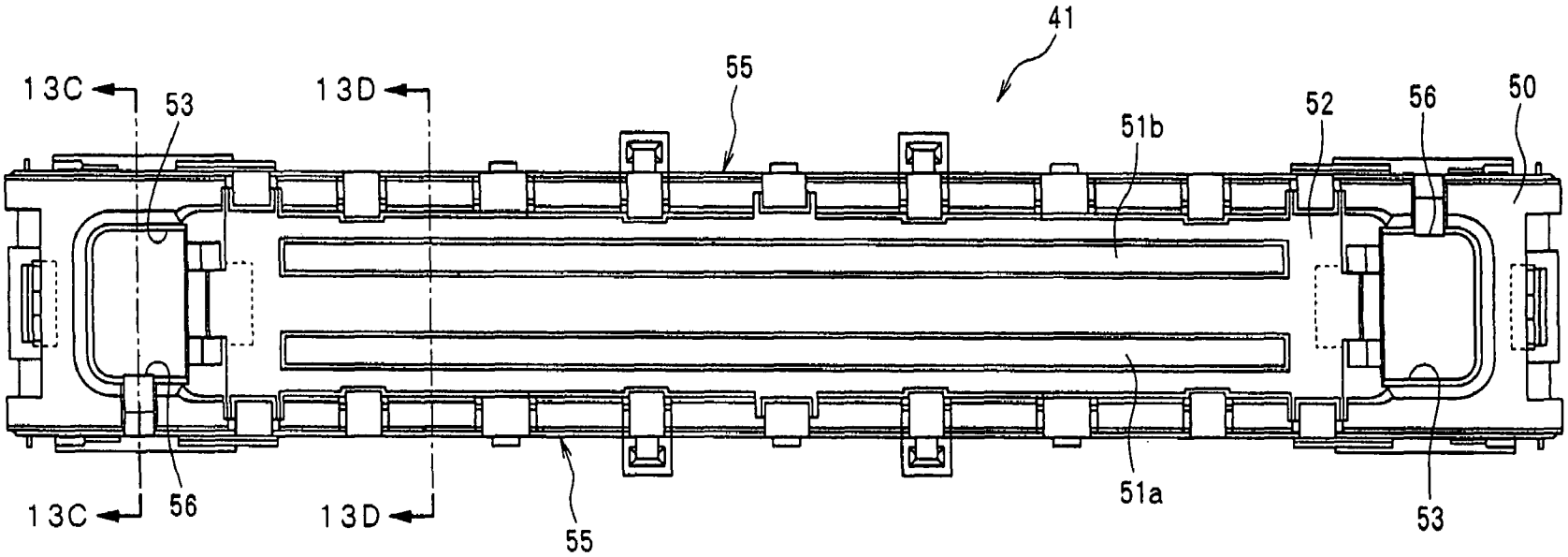
FIG. 12 is a plan view of the second connector.

As shown in FIG. 12, guide pin receiving openings 53 into which the guide members 21 of the guide pins 20 of the first connector 1 are inserted are formed in ends of the second housing 50 in the direction of length. As shown in FIG. 13D, a mating member 51 that opens above and that extends in the direction of length is formed in the second housing 50 so that the mating member 12 of the first connector 1 is caused to mate with the mating member 51 of the second connector 41. As shown in FIGS. 12 and 13D, a front wall 51*a* and a rear wall 51*b* that extend in the direction of length are provided inside the mating member 51. The front wall 51*a* and a rear wall 51*b* are positioned such that a space is provided there between. A blind plate 52 covers the mating member 51. The blind plate 52 is constantly biased upward by springs 59 installed inside the mating member 51, as shown in FIG. 13D. The springs 59 may be, for example, compression springs. The blind plate 52 is mounted on the mating member 51 so that blind plate 52 can move toward and away from the second housing 50.

Figure 13A:
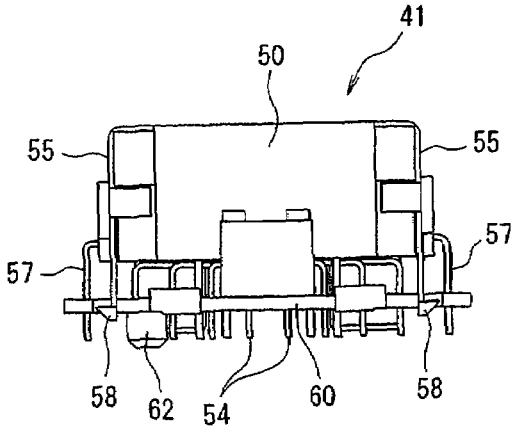
FIG. 13A is a right-side view of the second connector with a tine plate in an initial position.
Figure 13B:
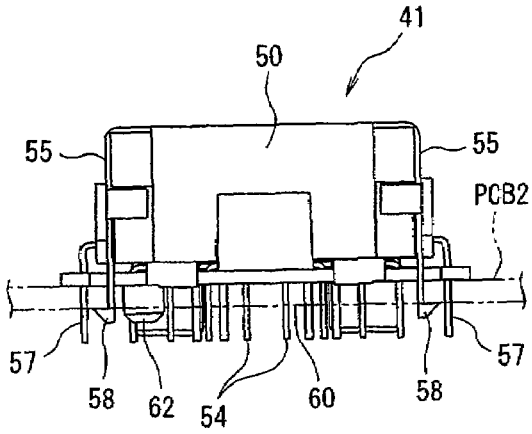
FIG. 13B is a right-side view of the second connector with the tine plate in a final position.
Figure 13C:
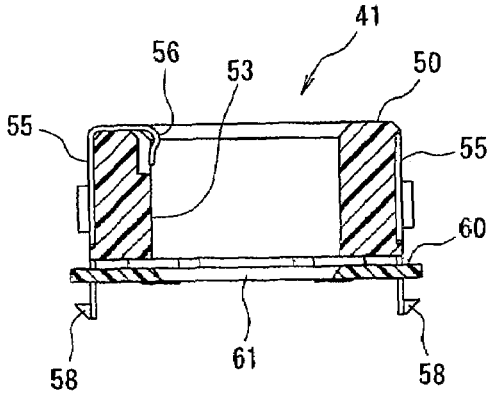
FIG. 13C is a sectional view along line 13C—13C of FIG. 12.
Figure 13D:
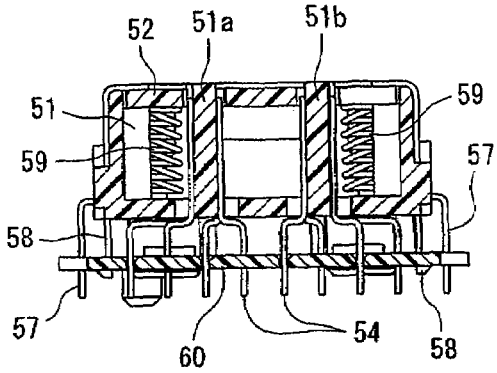
FIG. 13D is a sectional view along line 13D—13D of FIG. 12.

A plurality of contacts 54 are attached to the second housing 50 and are connected, for example, by soldering to the second circuit board PCB2, as shown in FIG. 13B. As shown in FIG. 13D, the contacts 54 are provided in rows on the front wall 51*a* and the rear wall member 51*b* and are designed to make contact with the contacts 16 of the first connector 1 when the first connector 1 and the second connector 41 are mated.

A tine plate 60 is provided on the second housing 50 for aligning the contact legs of the contacts 54. As shown in FIG. 14, the tine plate 60 is formed with a substantially rectangular shape that extends in the direction of length. A plurality of through-holes 60*a* through which the contact legs pass is provided in the tine plate 60. The tine plate 60 is designed to move between an initial position shown in FIGS. 13A and 13D and a final position shown in FIGS. 13B and 13C that is located above the initial position. The tine plate 60 is temporarily locked by the temporary locking pieces 58 in the initial position. As shown in FIG. 14, openings 61 through which the guide members 21 of the first connector 1 can pass are formed in ends of the tine plate 60 in the direction of length. A plurality of positioning posts 62 extend downward from a bottom surface of the tine plate 60 on both ends in the direction of length.

As shown in FIG. 11, metal shells 55 for shielding the second connector 41 are attached to front and rear surfaces of the second housing 50. Temporary locking pieces 58 for temporarily locking the tine plate 60 in the initial position extend downward from ends of the shells 55 in the direction of length. On an inside of the temporary locking pieces 58, grounding tongues 57 extend downward slightly for connection to the second circuit board PCB2. As shown in FIGS. 12, 13C, and 15A–15C, a lock releasing member 56 that releases the locking member 23 with respect to the corresponding fastening fitting 24 is formed at a left end (in the direction of length) of the front-side shell 55 and a right end (in the direction of length) of the rear-side shell 55. The lock releasing member 56 is formed by bending the shell 55 from an upper end toward an interior of the corresponding guide pin receiving opening 53.

A method for mating the first connector 1 and the second connector 41 will be described with reference to FIGS. 15A–15C. The first connector 1 is mounted on the first circuit board PCB1 provided on the side of the extension unit (not shown). The second connector 41 is mounted on the second circuit board PCB2 provided on the side of the personal computer (not shown). The tine plate 30 of the first connector 1 and the tine plate 60 of the second connector 41 are respectively located in the final position. As shown in FIG. 15A, the first connector 1 and the second connector 41 are caused to mate by inserting the guide members 21 of the first connector 1 into the guide pin receiving openings 53 in the second connector 41. The first connector 1 and the second connector 41 are guided by the guide members 21 and the guide pin receiving openings 53. Since the vertical movement of the guide members 21 is locked as a result of the locking projections 23*d* of the locking members 23 being locked in the locking apertures 24*d* in the fastening fittings 24, the mating of the first connector 1 and the second connector 41 is securely guided.

As shown in FIG. 15A, when the guide members 21 are first inserted into the guide pin receiving openings 53, the lock releasing members 56 contact the contact protruding members 23*c*. As a result, the first connector 1 and the second connector 41 are grounded by the shells 55, the locking members 23, and the fastening fittings 24. Accordingly, there is a constant potential between the first circuit board PCB1 and the second circuit board PCB2, which helps eliminate electrical failure.

As shown in FIG. 15B, as the mating of the first connector 1 and the second connector 41 is caused to precede, the lock releasing members 56 contact the locking projections 23*d*. The lock releasing members 56 unlock the locking projections 23*d* by displacing the locking projections 23*d* in the direction of arrow A. As a result, vertical movement of the guide members 21 is made possible. The upper ends of the guide members 21 pass through the openings 61 formed in the tine plate 60 of the second connector 41 and contact the second circuit board PCB2. The guide members 21 extend upward until this point so that guiding is ensured. After releasing the locking projections 23*d*, the lock releasing members 56 slide along the outer surfaces of the fastening fittings 24, as shown in FIG. 15C. Grounding of the first connector 1 and the second connector 41 is therefore maintained.

When mating is completed, the guide members 21 are compressed inside the guide pin receiving openings 53 in the second connector 41 so that portions of the guide members 21 are positioned inside the guide pin accommodating members 14 in the first connector 1, as a result of being pressed by the second circuit board PCB2. The guide members 21 do not protrude beyond the attachment surface of the second connector 41 with respect to the second circuit board PCB2. Consequently, there is no need to form openings in the circuit board PCB2 through which the guide pins must pass for mounting the second connector 41. The docking connector is therefore suitable for high-density mounting.

When the mating of the first connector 1 and the second connector 41 is completed, the contacts 16 of the first connector 1 and the contacts 54 of the second connector 41 make contact so that the first and second circuit boards PCB1, PCB2 are electrically connected to each other. To release the first connector 1 from the second connector 41, for example, the second connector 41 can be simply pulled upward.

In the docking connector of the present invention, the method of locking the vertical movement of the guide members 21 is performed by the metal fastening fittings 24 on the first housing 10 that are fastened to the first circuit board PCB1, and the metal locking members 23 on the guide members 21 and that are locked with the fastening fittings 24. The method of releasing the guide members 21 is performed by the lock releasing members 56 of the metal shells 55 that are provided on the second housing 50, which release the locking members 23 with respect to the fastening fittings 24 and are connected to the second circuit board PCB2. Thus, the fastening fittings 24 have both the function of fastening the first housing 10 to the first circuit board PCB1 and the function of locking the locking members 23, and the shells 55 have both the function of shielding the second connector 41 and the function of releasing the locking of the locking members 23 with respect to the fastening fittings 24. Accordingly, a simple construction is used to lock and unlock the guide members 21.

The present invention is not limited to the embodiment described herein. It will be appreciated by those skilled in the art that various alterations or modifications can be made without departing from the scope and spirit of the invention. For example, it is not necessary that the fastening fittings be provided on the first housing 10 and be fastened to the first circuit board PCB1 or that the locking members 23 be provided on the guide members 21 and be locked with the fastening fittings 24. Further, it is not necessary that the shells 55 be provided on the second housing 50 or that the locking members 23 with respect to the fastening fittings 24 be positioned on the other side. Moreover, it is not necessary to construct the locking members 23 and the shells 55 such that they contact each other before releasing the locking members 23.

I claim:

1. A docking connector, comprising:

a first connector having an insulating first housing, the first housing including guide pins that extend from a mating surface of the first housing, the guide pins being moveable toward and away from the first housing, the guide pins being locked in a position away from the first housing by a locking member; and a second connector having an insulating second housing, the second housing including guide pin receiving openings that receive the guide pins, the second connector having a lock release member for unlocking the guide pins during insertion of the guide pins in the guide pin receiving openings.

2. The docking connector of claim 1, wherein the guide pins are moveable toward and away from the first housing by a spring that biases the guide pins away from the first housing.

3. The docking connector of claim 1, wherein the first connector is mounted on a first circuit board and the second connector is mounted on a second circuit board, the first and second connector each having contacts that contact each other when the first connector is mated with the second connector.

4. The docking connector of claim 1, wherein the lock release member is positioned inside the guide pin receiving openings.

5. The docking connector of claim 4, wherein the lock release member is formed on an end of a metal shell.

6. The docking connector of claim 5, wherein the metal shell includes a grounding tongue.

7. The docking connector of claim 1, wherein the locking member is a metal locking plate having a locking projection that engages in a metal fastening fitting.

8. The docking connector of claim 7, wherein the fastening fitting is arranged on an outer surface of the guide pins.

9. The docking connector of claim 8, wherein the lock release member is formed on an end of a metal shell that has a grounding tongue, the metal locking plate and the metal shell contact each other before the lock release member unlocks the guide pins.

10. A first connector for mating with a second connector of a docking connector, comprising:

an insulating first housing, having a mating member provided with a plurality of contacts, the mating member having guide pin receiving recesses; and the first housing including guide pins that extend from a mating surface of the first housing that are receivable in the guide pin receiving recesses, the guide pins being moveable toward and away from the first housing, the guide pins being locked in a position away from the first housing by a locking member, wherein the locking member is a metal locking plate having a locking protection that engages in a metal fastening fitting.

11. The first connector of claim 10, wherein the guide pins are moveable toward and away from the first housing by a spring that biases the guide pins away from the first housing.

12. The first connector of claim 10, wherein the fastening fitting is arranged on an outer surface of the guide pins.

13. The first connector of claim 10, wherein the first connector is mounted on a first circuit board and is provided with a plurality of contacts.

14. A second connector for mating with a first connector of a docking connector, comprising:

an insulating second housing, the second housing including guide pin receiving openings, the second connector having a lock release member positioned inside the guide pin receiving openings, the lock release member being formed on an end of a metal shell, the metal shell including a grounding tongue.

15. The second connector of claim 14, wherein the second connector is mounted on a second circuit board and is provided with a plurality of contacts.

* * * * *